US005815983A

United States Patent [19]

Lodge

[11] Patent Number: 5,815,983

[45] Date of Patent: Oct. 6, 1998

[54] DRIVEWAY GATE SYSTEM

[76] Inventor: John W. Lodge, 1 John Ringling Blvd., Sarasota, Fla. 34238

[21] Appl. No.: 831,911

[22] Filed: Apr. 2, 1997

[51] Int. Cl.[6] ..... E06B 7/00

[52] U.S. Cl. ..... 49/68; 49/93; 49/95; 160/327

[58] Field of Search ..... 49/34, 49, 68, 49/73.1, 93, 95, 96; 160/327, 328

[56] References Cited

U.S. PATENT DOCUMENTS 374,772 12/1887 Beshoar ..... 49/93
1,832,812 11/1931 Keenan ..... 49/93 X

FOREIGN PATENT DOCUMENTS 110699 5/1900 Germany ..... 49/93

*Primary Examiner*—Jerry Redman

[57] ABSTRACT

A motor-vehicle gate assembly for a driveway includes, in addition to the gate and an actuator for opening and closing the gate, a secondary barrier operable in response to operation of the gate to prevent motor-vehicle access to the gate when the latter is closed and to permit access to the gate when the latter is open. The barrier may be a flexible line which extends across the driveway and which is movable between a raised position above the driveway and a lowered position in a gutter in the surface of the driveway. Movement of the barrier between its raised and lower positions can be effected by a mechanical connection between the barrier and the gate.

6 Claims, 2 Drawing Sheets

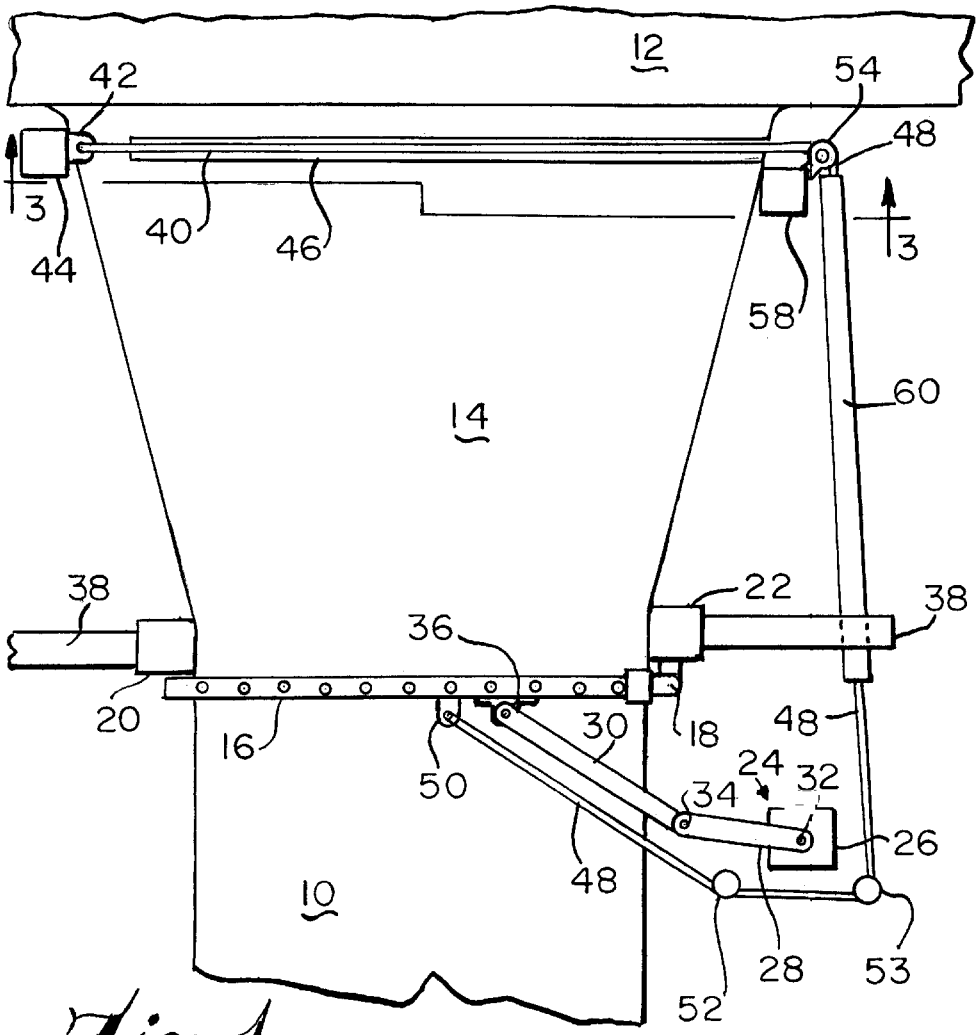
Fig. 1.
Fig. 3.
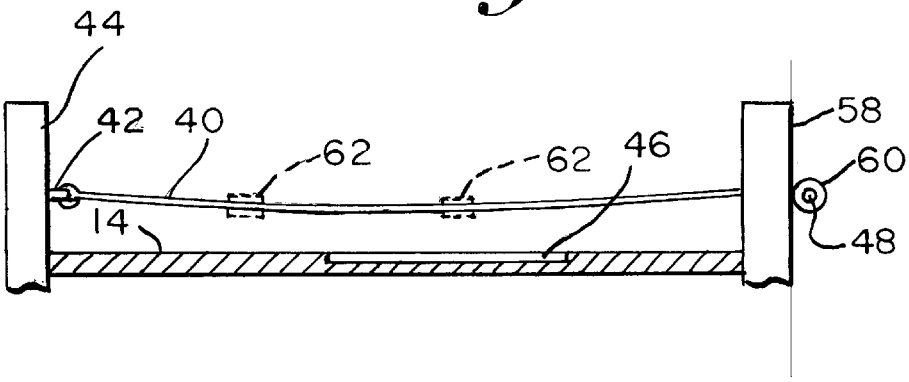

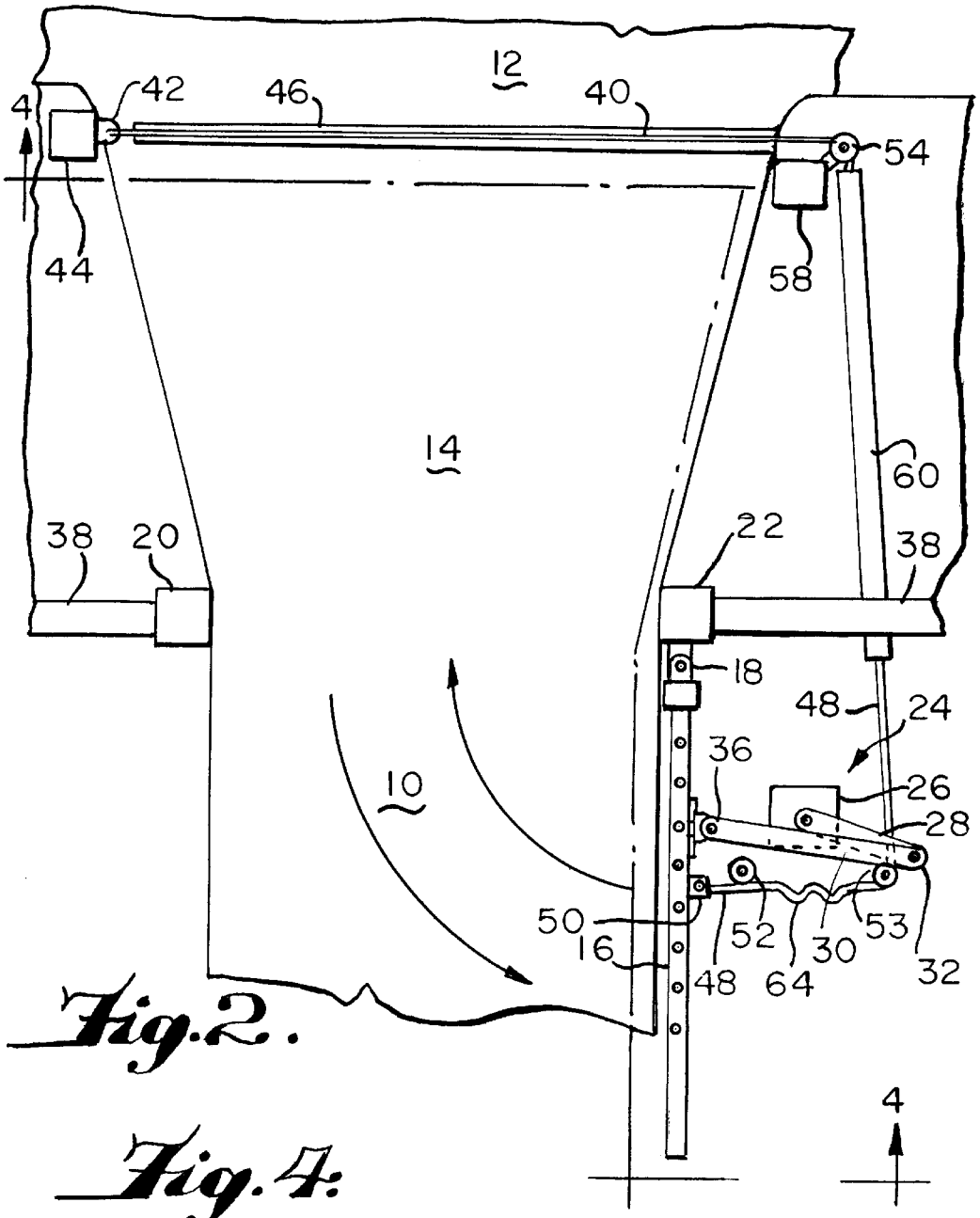
Fig. 2.
Fig. 4.
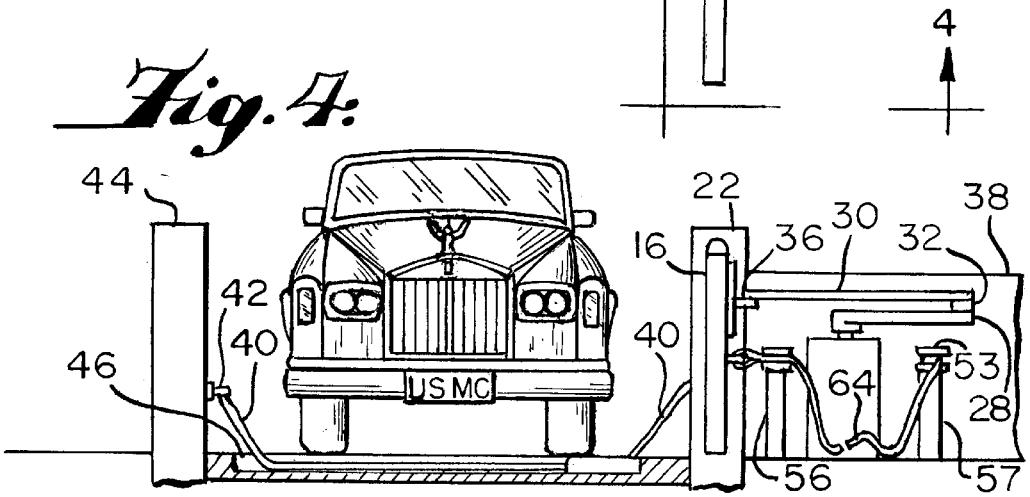

DRIVEWAY GATE SYSTEM

This invention relates to automatic gate assemblies for motor vehicle driveways and in particular to the provision of such assemblies with a secondary vehicle barrier spaced from the gate and being of a special construction and operation such that a motor vehicle can access the driveway adjacent the gate only when the gate is open.

SUMMARY OF THE INVENTION

The secondary barrier of the invention provides several advantages depending in part on the location of the driveway relative to the main roadway with which the driveway intersects and in part on the nature of the pedestrian and vehicular traffic on the roadway. The arrangement and operation of the barrier was developed most specifically for a driveway which intersects a congested roadway where vehicles are likely to be competing for public parking spaces and/or seeking to turn around in order to reverse direction. In these situations the barrier, when located at the intersection of the driveway and roadway, prevents an unauthorized vehicle from parking in the driveway and from using the driveway as a turn-around. Either of these situations can result in damage to the gate by contact of the unauthorized vehicle with the gate. And, of course, an unauthorized vehicle parked in the driveway prevents the property owner from using the driveway. When pedestrian traffic is heavy alongside the roadway, the barrier presents an obstacle to the pedestrians' approach to the gate. And, regardless of the location of the barrier relative to a roadway, the barrier prevents access of a vehicle to the gate until the latter is open.

In a preferred construction the barrier may be simply a flexible line such as a cable, chain, rope or the like which extends across the driveway and which, when the gate is open, lies in a lowered position at the surface of the driveway, preferably in a shallow slot or gutter in that surface but in some cases on that surface. When tension is applied to the barrier, the latter rises to a position above the driveway; this tension can be effected in response to the closing of the gate, by which is meant either direct response to closing movement of the gate or movement of a part of the typical power-operated actuator for the gate. When tension on the cable or chain is released, in response to the opening movement of the gate, the cable or chain moves downwardly by gravity to its lowered position in which it will not interfere with the passage of a vehicle over it.

In this preferred construction the means for applying tension to the barrier and for releasing that tension can be simply a flexible extension of that cable or chain, either an integral part of the chain or cable or a separate member connected to the chain or cable. In either case the extension can be attached at one end to a movable part of the gate actuator or to the gate itself and run over pulleys or the like which allow for the movement of the extension along its axis. It is necessary of course that the weight of the barrier cable or chain be sufficient to ensure that the barrier will drop by gravity when tension is released. This can be achieved, for example, by attaching one or more small weights to the barrier if necessary or by using a chain or cable of substantial weight.

BRIEF DESCRIPTION OF THE DRAWINGS

An embodiment of the invention is illustrated in the drawings in which:

FIG. 1 is a schematic plan view of a driveway and gate assembly, with the gate closed, incorporating an auxiliary barrier embodying the principles of the present invention;

FIG. 2 is a plan view of the components of FIG. 1 shown with the gate open;

FIG. 3 is a vertical sectional view taken generally on the line 3—3 of FIG. 1 and partly broken away; and FIG. 4 is a vertical sectional view taken generally on the line 4—4 of FIG. 2 and partly broken away. In addition the illustrates the position of a motor vehicle passing through the gate.

DETAILED DESCRIPTION OF THE INVENTION

The invention is illustrated in the drawings in conjunction with a private driveway which intersects with a public roadway 12 via an apron portion 14. A gate assembly at the junction of the driveway 10 and the apron 14 includes a gate 16 mounted for swinging movement about a vertical axis 18 located just to one side of the driveway 10. Gate posts 20,22 are set in the ground on either side of the driveway 10, and the gate 16 is positioned to open and close the space between them. In FIG. 1 the gate 16 is shown closed, and in FIG. 2 the gate 16 is shown open.

Opening and closing of the gate 16 is effected by a power-operated actuator 24. In the illustrated construction the actuator 24 includes a ground-supported power unit 26, a swing arm 28 and a pull-push arm 30 connected between the swing arm 28 and the gate 16. The swing arm 28 is fixed at its inner end to a vertical shaft 32 which is rotatable clockwise and counter-clockwise by the power unit 26. The outer end of the swing arm 28 is pivotally connected at 34 to the inner end of the push-pull arm 30. The outer end of the push-pull arm 30 is pivotally connected at 36 to the gate 16.

When the power unit is operated from the FIG. 1 position, as by a remote control signal or a push button, neither of which is shown, the swing arm 28 is rotated counter-clockwise from its FIG. 1 position to its FIG. 2 position. This pulls the arm 30 to its FIG. 2 position, causing the gate 16 to swing counter-clockwise to its open position. Reverse operation of the power unit 26 returns the components to their FIG. 1 position.

In the illustrated embodiment the private property accessed by the driveway 10 is provided with a fence 38 which conveniently can abut the gate posts 20,22.

All of the above may be conventional. In accordance with the principles of the present invention the gate system is provided with an auxiliary barrier which prevents access of a motor vehicle to the gate 16 when the gate is closed. In the preferred arrangement the barrier is located in front of the gate 16 essentially at the intersection of the driveway 10,14 with the roadway 12, as this affords special advantages. For other purposes the barrier could be located behind the gate 16, i.e. on side of the gate 16 facing away from the roadway 12.

The preferred barrier is a flexible line such as a cable or chain, as illustrated at 40, extending across the driveway 10,14. Its free end, the left-hand end as viewed in the drawings, is attached as by an eye bolt 42 to a fixed post 44 at an elevation of perhaps 2 to 3 feet above the driveway 10,14. The central portion of the barrier 40 can reside in a down position essentially at the surface of the driveway 10, 14 or be raised to an up position above the driveway 10,14. In the down position the barrier 40 allows a vehicle to be driven over it; in the up position the barrier 40 blocks passage of a vehicle. To insure that a vehicle passing over the lowered barrier 40 does not become entangled with the latter, a transverse slot 46 or gutter is provided in the driveway 10,14 to receive the central portion of the barrier 40 in its down position.

In the preferred construction, as described previously, raising and lowering the barrier 40 is effected, respectively, by applying a tension force to the barrier 40 along its length and by releasing that tension force. The means for doing this can be simply a control cable 48 in the form of an extension of the barrier 40 connected at its inner end 50 to the rear face of the gate 16 such that the swinging movement of the latter is translated into either pulling force on the control cable 48 or a release of that force. While the control cable 48 is illustrated in the drawings as being an extension of the cable forming the barrier 40, it can of course be a separate cable or other flexible member mechanically connected to the right hand end of barrier 40.

To enable the control cable 48 to perform its desired function it is guided and supported by three pulleys 52,53 and 54. The pulleys 52 and 53 located inside the gate 16, are mounted on vertical supports 56 and 57 which are set into the ground. The pulley 54 located outside gate 16, is mounted on a fixed post 58 which is adjacent the barrier 40. Between the two pulleys 53 and 54 the control cable 48 passes through a stationary tube 60, such as a length of plastic water pipe, which prevents interference with the cable 48 during its longitudinal movement The tube 60 carries the cable 48 through a hole in the fence 38 and through any shrubbery or mounded earth which might be present adjacent the fence 38. The pulley 54, like the eye bolt 42 for the free end of the barrier 40, is located above the driveway 10,14.

It is necessary that the weight of the barrier 40 be sufficient to ensure that it will move downwardly under gravity when tension on the gate-end of the control cable 48 is released. If the barrier 40 is not sufficiently heavy, friction between the control cable 48 and the pulleys 52, 53 and 54 and the control cable 48 may prevent the barrier 40 from moving downwardly when the pulling force of the gate is released. The extra weight can be achieved in any of several ways as by attaching weights, illustrated in dotted lines 62 in FIG. 3, to the barrier 40 or by constructing the barrier 40 of a length of heavy chain.

In the illustrated arrangement an existing gate and gate actuator have been retrofitted with a barrier system embodying the principles of the present invention. The system can of course be included in the initial installation of a gate system. Further, while the illustrated control cable and pulley system has special advantages, as described herein, the principles of the invention extend to other means for raising and lowering the barrier in response to opening and closing of the gate. For example, pulling on and releasing the barrier to the up and down movement of the latter can be effected from a moving part of the gate actuator or by a distinct power system which operates automatically when the gate actuator operates.

OPERATION

Operation of the gate and barrier system has been described above in conjunction with the description of the structure and may be summarized as follows.

The gate 16 is normally closed as shown in FIG. 1 and is held in this position by the gate actuator 24,26,30. The control cable 48 is under substantial tension which is sufficient to hold the barrier 40 in its up position as shown in FIG. 3.

When the power-operated actuator 24 is operated in an open-gate mode from a push-button console or hand-held remote control unit, the swing arm 28 is rotated counter-clockwise as viewed from above from its FIG. 1 position to its FIG. 2 position. This causes the push-pull arm 30 to pull on the gate 16, causing it to swing counter-clockwise to its open position. As the gate 16 begins to move, tension in the control cable 48 begins to decrease, with the result that the barrier 40 begins to move downwardly by gravity, pulling the control cable 48 along its length. There will thus be some longitudinal movement of the right-hand end portion of the barrier 40 as it moves downwardly. The barrier 40 comes to rest in the slot 46, except for the outer end portion which is fixed to the post 44 and which thus remains elevated above the driveway 10,14. The barrier 40 drops into the slot 46 well before the gate 16 reaches its open position, because a relatively small amount of longitudinal movement of the control cable 48 is all that is necessary to drop the barrier 40 to its lowermost position. The gate 16 continues to swing, however, to its full open position, resulting in considerable loosening of the control cable 48. Inasmuch as the barrier 40 tends to pull on the outer end of the control cable 48, loosening of the latter is greater near its inner end, as between the pulley 52 and the inner end 50 of the control cable 48 or between the pulleys 52 and 53. FIG. 2 illustrates this loosening or slack at 64.

After a motor vehicle has passed through the open gate 16, the gate actuator 24 can be operated to close the gate. The swing arm 28 rotates clockwise with the result that the push-pull arm 30 pushes on the gate 16, causing it to swing clockwise to the FIG. 1 position. The resulting tension on the control cable 48 first removes the slack 64 in the latter and then pulls the barrier 40 to cause it to rise out of the slot 46. Therefore, the barrier 40 begins to rise only as the gate 16 approaches the full closed position.

As described previously, the barrier 40 prevents a motor vehicle from approaching the closed gate 16 and thus prevents accidental damage to the latter in the event that an unauthorized vehicle attempts to park on the apron 14 or to use the apron 14 for turn-around purposes. The barrier 40 also discourages pedestrians from entering onto apron 14. This latter function is achieved essentially without the danger of injury to a person who might inadvertently come into contact with the barrier 40 during movement thereof. That is, the simple up and down movement of the barrier 40, which is restricted to several feet at most, is not likely to cause injury to a person, unlike the movement of a vertically or horizontally swinging rigid barrier. Further, when the control cable 48 becomes slack upon opening of the gate 16, the slack 64 occurs inside rather than outside the gate 16 so that a pedestrian cannot become entangled with the slack.

What is claimed is:

1. In a motor vehicle gate assembly including a gate moveable between opened and closed positions and a power operated actuator for moving the gate between said positions, the improvement which comprises: a flexible horizontally extending motor vehicle barrier spaced from the gate, said barrier having a fixed stationary end and an opposite end; a flexible control line having a first and connected to gate assembly and a second end connected to said opposite end of said barrier in a manner such that closing movement of said gate applies tension to said control line and hence to said barrier to cause the latter to rise when said gate closes and such that opening movement of said gate releases tension on said control line and hence on said barrier to permit the latter to lower when said gate opens.

2. A gate assembly as in claim 1 wherein said gate is a swingable gate mounted for swinging movement about a vertical axis and wherein said flexible control line for said barrier is connected to said gate assembly at a location horizontally spaced from said vertical axis.

3. In combination with a motor vehicle driveway and a gate assembly which includes a gate having a front and rear and hinged for swinging movement about a vertical axis located at one side of the driveway such that the gate can swing between open position generally parallel to the driveway and a closed position generally transverse to the driveway and said gate assembly including a power-operated actuator located adjacent the vertical swinging axis of the gate and mechanically connected to the gate for swinging the latter between its open and closed positions: a flexible barrier extending across the driveway at a location forward of the gate, support means supporting an end portion of the barrier at a fixed location above and to one side of the driveway, and actuator means for raising the barrier in response to closing movement of the gate by applying tension to the barrier and for lowering the barrier to the surface of the driveway in response to opening movement of the gate by releasing tension on the barrier such that the barrier moves downwardly by gravity, said actuator means including a flexible control line connected between the gate assembly and the barrier such that swinging movement of the gate toward its closed position applies tension to the barrier and such that swinging movement of the gate toward its open position releases tension on the barrier.

4. In a gate assembly and a motor vehicle driveway, the driveway having an outer end connecting with a generally transverse roadway, and the gate assembly including a gate hinged at one side of the driveway for a swinging movement about a vertical axis between first and second positions generally transverse to and generally parallel to the driveway, respectively, and a power-operated actuator for moving the gate between said positions, the improvement which comprises a flexible barrier extending across the driveway near the junction thereof with the roadway, said barrier being moveable vertically between an up position blocking access of a motor vehicle into the driveway from the roadway and a down position adjacent the driveway surface in which a motor vehicle can drive over the barrier, and barrier-operation means responsive to swinging of the gate to raise the barrier to its up position as the gate swings to its first position and to lower the barrier to its down position as the gate swings to its second position.

5. A driveway and gate assembly as in claim 4 wherein the barrier is a flexible line having a free end fixed at one end to a support located to one side of the driveway, said fixed end being at a location above the driveway; and wherein the barrier operating means includes a flexible control line extending between the gate assembly and the barrier such that the swinging of the gate toward its first position tensions the barrier causing it to rise to its up position and such that the swinging of the gate toward its second position releases tension on the barrier allowing it to drop by gravity to its down position, the barrier weight being greater than the control line weight.

6. A driveway and gate assembly as in claim 5 including ground-supported pulleys guiding the flexible control line.

* * * * *